US009027544B2

(12) United States Patent
Zoucha

(10) Patent No.: US 9,027,544 B2
(45) Date of Patent: May 12, 2015

(54) PROTECTIVE GRILL FOR AN INFRARED HEATER

(71) Applicant: James Zoucha, Orchard, NE (US)

(72) Inventor: James Zoucha, Orchard, NE (US)

( * ) Notice: Subject to any disclaimer, the term of this patent is extended or adjusted under 35 U.S.C. 154(b) by 353 days.

(21) Appl. No.: 13/622,049

(22) Filed: Sep. 18, 2012

(65) Prior Publication Data

US 2014/0076300 A1 Mar. 20, 2014

(51) Int. Cl.

| | |
|---|---|
| ***F24C 15/36*** | (2006.01) |
| ***F24H 9/20*** | (2006.01) |
| ***F24H 3/00*** | (2006.01) |
| ***F24H 9/00*** | (2006.01) |

(52) U.S. Cl.

CPC ..... *F24H 9/2085* (2013.01); *F24H 3/006* (2013.01); *F24H 9/0094* (2013.01)

(58) Field of Classification Search

USPC ..... 126/201

See application file for complete search history.

(56) References Cited

U.S. PATENT DOCUMENTS

| | | | | |
|---|---|---|---|---|
| 4,089,258 | A | 5/1978 | Berger | |
| 4,421,015 | A | 12/1983 | Masters et al. | |
| 6,276,356 | B1 | 8/2001 | Ragland et al. | |
| 6,732,637 | B2 | 5/2004 | Artt | |
| 6,884,065 | B2 * | 4/2005 | Vandrak et al. | 432/222 |
| 2004/0074725 | A1 * | 4/2004 | Shih | 190/115 |
| 2009/0241614 | A1 * | 10/2009 | Hahn | 70/201 |
| 2010/0095480 | A1 * | 4/2010 | Scicluna | 16/113.1 |

* cited by examiner

*Primary Examiner* — Gregory Huson
*Assistant Examiner* — Rabeeul Zuberi
(74) *Attorney, Agent, or Firm* — Dennis L. Thomte; Thomte Patent Law Office LLC

(57) ABSTRACT

A protective grill is provided for a portable infrared heater which reduces the possibility of a person from coming into contact with the radiation disk of the heater. The protective grill of this invention may be selectively detachably secured to the wheeled frame of a heater wherein the radiation disk thereof is positioned at one side of the wheeled frame or which may be selectively secured to the wheeled frame of the heater wherein the radiation disk of the heater is positioned at one end of the heater.

10 Claims, 7 Drawing Sheets

PROTECTIVE GRILL FOR AN INFRARED HEATER

BACKGROUND OF THE INVENTION

1. Field of the Invention

This invention relates to a protective grill for an infrared heater. More particularly, this invention relates to a protective grill which is secured to the wheeled frame of the infrared heater and which has an outer end positioned a considerable distance from the radiation disk of the heater to reduce the possibility of a person coming into contact with the radiation disk or the guard which may be positioned immediately outwardly of the radiation disk of the prior art.

2. Description of the Related Art

Most infrared heaters on the market today have a guard which is positioned a few inches forwardly of the radiation disk of the heater. Those guards become extremely hot during the operation of the heater. If a person should come into contact with the guard, the person may possibly suffer extreme burns. In an effort to prevent a person from accidently coming into contact with those guards which are spaced a few inches from the radiation disk of the infrared heater, a free-standing fence is sometimes positioned in front of the radiation disk. However, if a person should accidently fall onto the free-standing fence, the free standing fence will most likely fall onto the radiation disk of the infrared heater with the person suffering burns. Further, if the heater is moved from one location to another, the free-standing fence must also be moved from one location to another.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A protective grill is provided for use with a portable infrared heater having a radiation disk at either one of the heater or at one side of the heater. In either case, the protective grill is selectively removably secured to the wheeled frame of the heater to reduce the possibility that a person may inadvertently come into contact with the radiation disk of the heater.

In the first embodiment, the portable infrared heater has a wheeled frame with a first end, a second end, a first side and a second side, with the infrared heater having a radiation disk at the second side thereof which directs infrared rays outwardly from the second side. The grill of the first embodiment includes a first elongated, generally horizontally disposed hollow tube member having first and second ends with the first tube member being secured to the wheeled frame at the first end thereof. The first embodiment also includes a first elongated, generally vertically disposed hollow post member which is secured to the first tube member between the first and second ends thereof and which extends upwardly therefrom. The first embodiment includes a second elongated, generally horizontally disposed hollow tube member having first and second ends with the second tube member being secured to the wheeled frame at the second end thereof. A second elongated, generally vertically disposed hollow post member is provided having upper and lower ends with the lower end of the second post member being secured to the second tube member between the first and second ends thereof and which extends upwardly therefrom.

The first embodiment includes a grill member having a generally horizontally disposed first leg portion with first and second ends, a generally horizontally disposed second leg portion with first and second ends, and a generally horizontally disposed third leg portion having first and second ends. The second end of the first leg portion of the grill member is secured to the first end of the third leg portion of the grill member. The second end of the second leg portion of the grill member is secured to the second end of the third leg portion of the grill member. The first end of the first leg portion of the grill member is selectively removably received by the second end of the first tube member and the first end of the second leg portion of the grill member is selectively removably received by the second end of the second tube member.

The third leg portion of the first embodiment of the grill member is positioned at least 12 to 24 inches from the radiation disk. The first ends of the first and second leg members of the grill member are removable from the second ends of the first and second tube members respectively and may be insertable into the upper ends of the first and second post members respectively to position the grill member in a vertically disposed position above the heater for transport purposes to enable the heater to be moved through a doorway or the like.

In the second embodiment, which includes the grill member of the first embodiment, the radiation disk is positioned at the second end of the wheeled frame of the portable infrared heater with the radiation disk directing infrared rays outwardly from the second end thereof. The second embodiment of the invention is substantially identical to the first embodiment of the invention except that in the second embodiment, the grill member extends from the end of the wheeled frame rather than the side which eliminates the need for removing the grill member from the heater to enable the heater to be moved through a doorway or the like.

It is therefore a principal object of the invention to provide a protective grill for a portable infrared heater.

A further object of the invention is to provide a protective grill which is easily selectively removably secured to a portable infrared heater regardless of whether the radiation disk of the heater is positioned at one end of the wheeled frame or at one side of the wheeled frame.

A further object of the invention is to provide a protective grill for a portable infrared heater which reduces the possibility of a person from coming into contact with the radiation disk of the heater.

A further object of the invention is to provide a protective grill of the type described wherein the grill member thereof is easily moved from an operative position to a transport position.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The drawings illustrate two different infrared heaters which are manufactured and sold by Shizouka Seika Co., Ltd., having an address of having an address of 4-1 Yamana Fukuroi-shi, Shizouka-ken, Japan 437-8601. The protective grill of this invention may be used in conjunction with Model No. VAL6 KBE5S and may be used in conjunction with Model No. VAL6 EPX. It should be noted that Applicant's grill may be used with the infrared heaters of other manufacturers.

Figure 4:
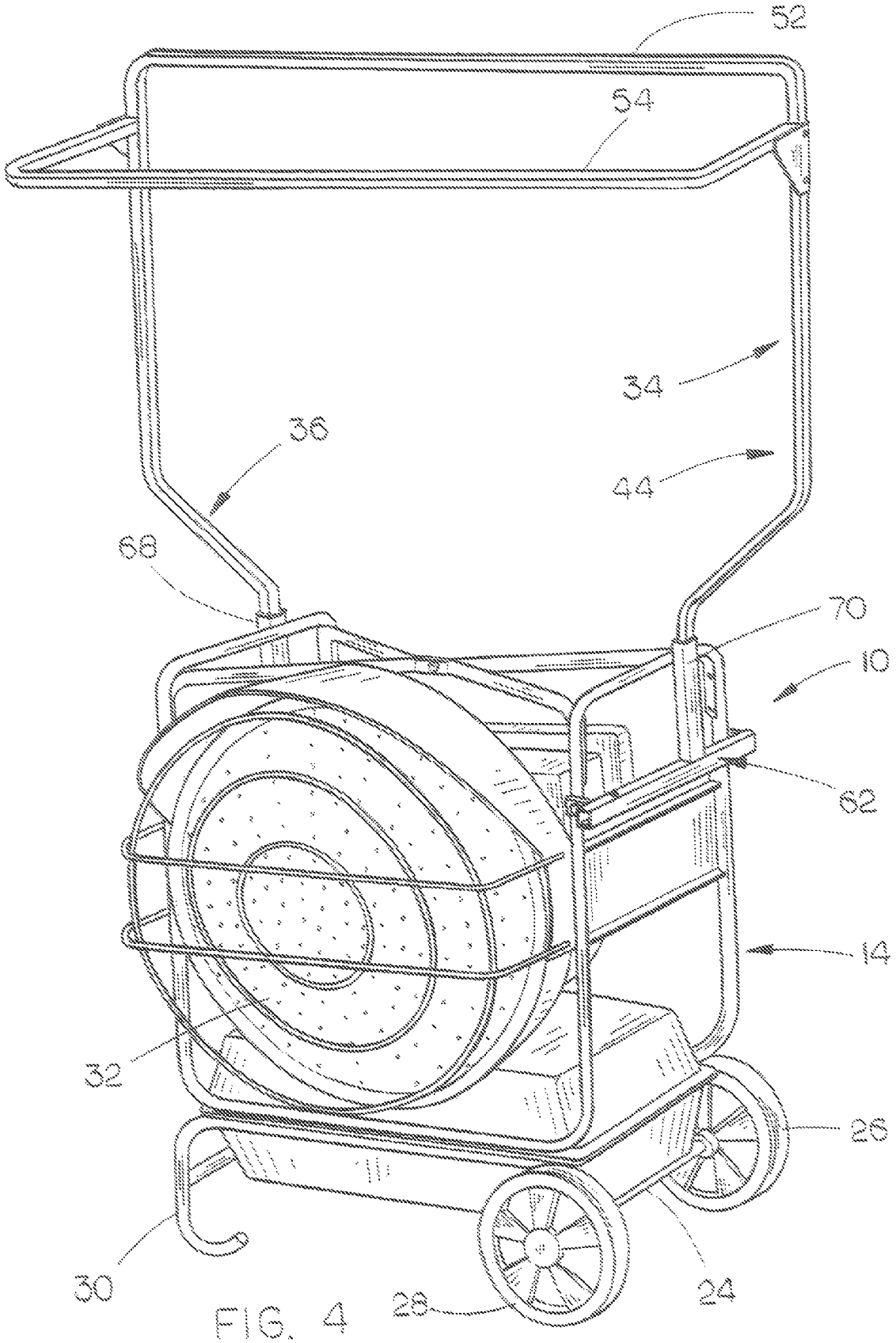
FIG. 4 is a perspective view illustrating the grill in its transport position.
Figure 5:
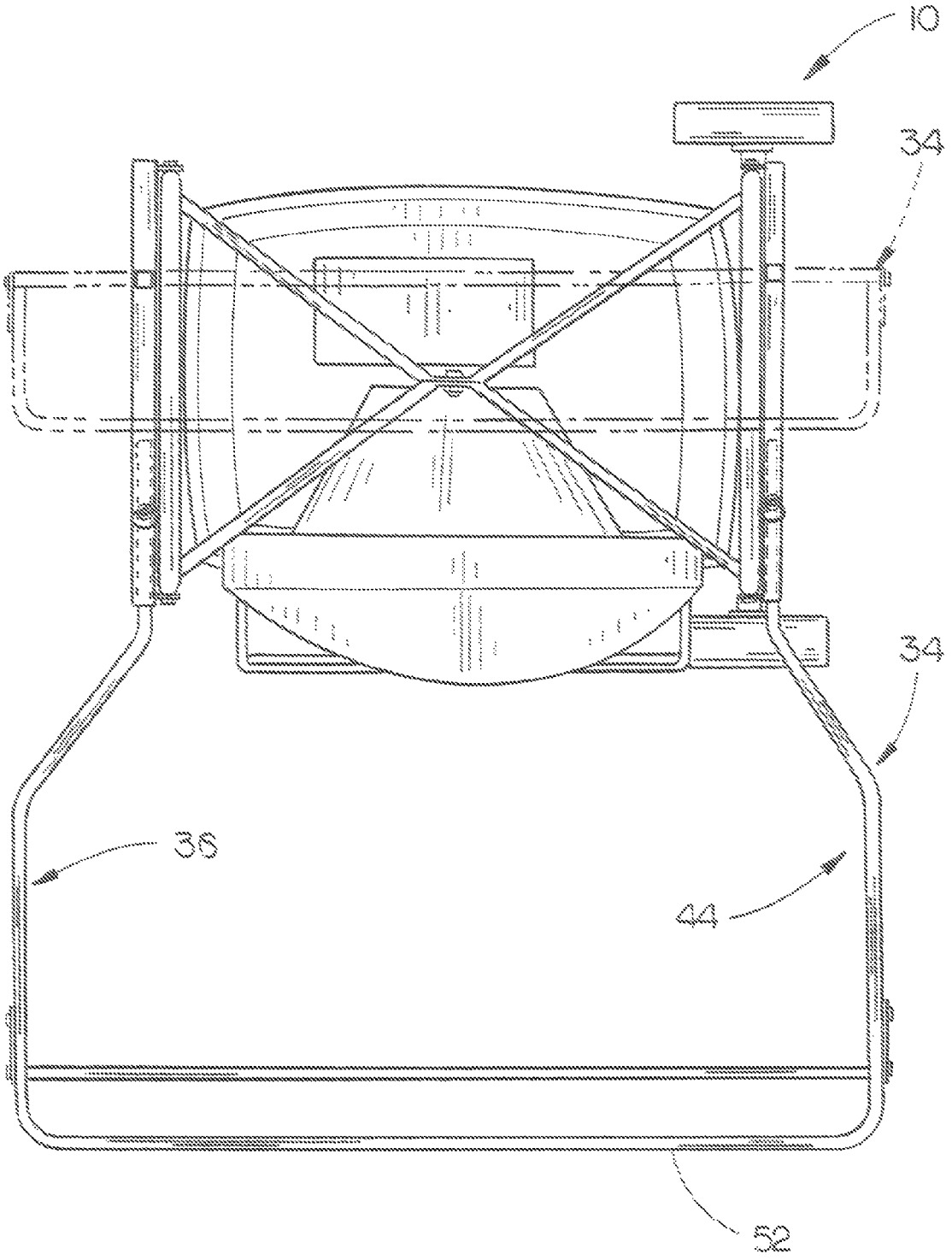
FIG. 5 is a top elevational view of the first embodiment which illustrates the grill in solid lines in its operative position and which illustrates the grill in broken lines in its transport position.
Figure 6:
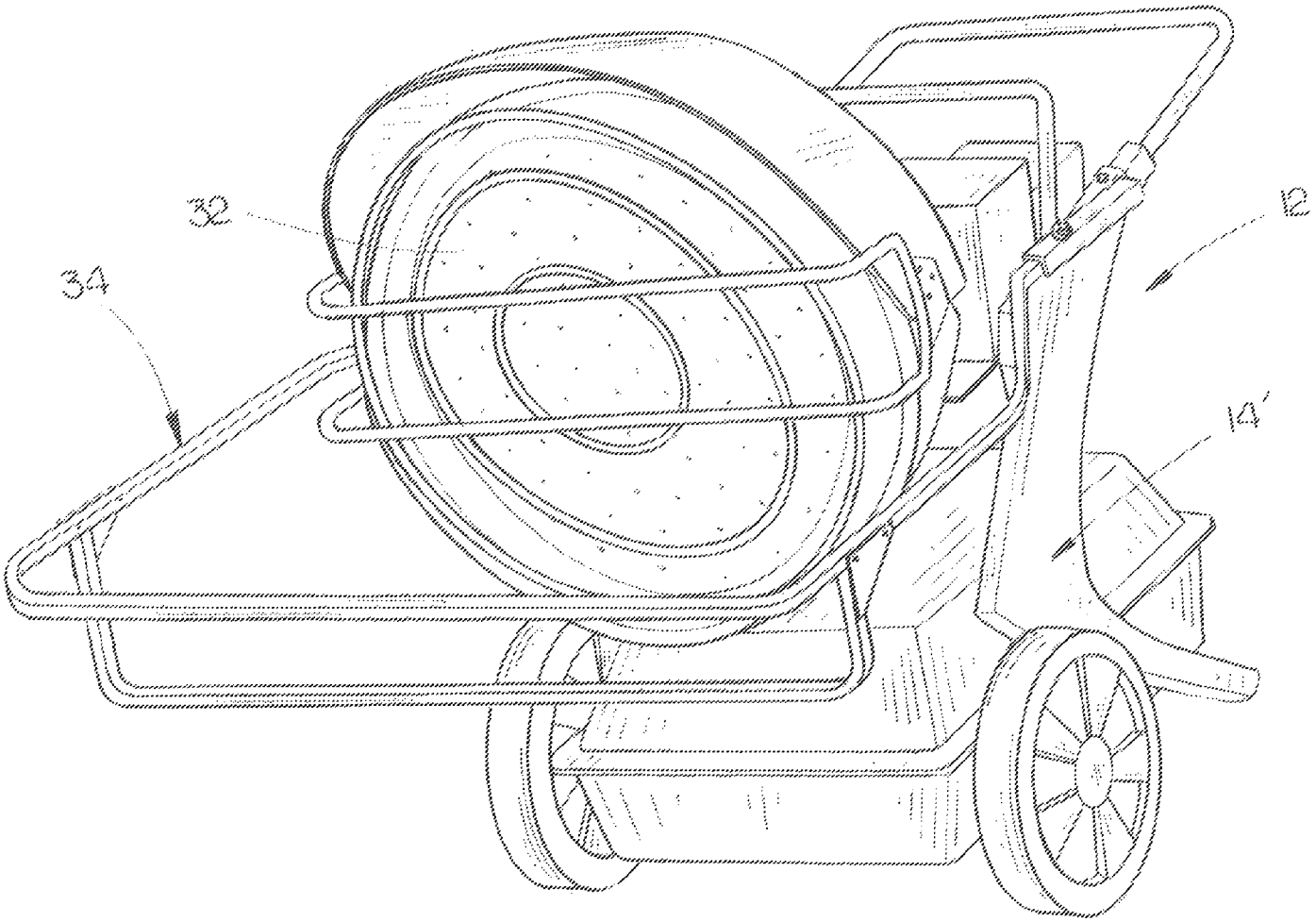
FIG. 6 is a perspective view of the grill of this invention secured to the wheeled frame of an infrared heater wherein the radiation disk is positioned at one end of the heater.
Figure 7:
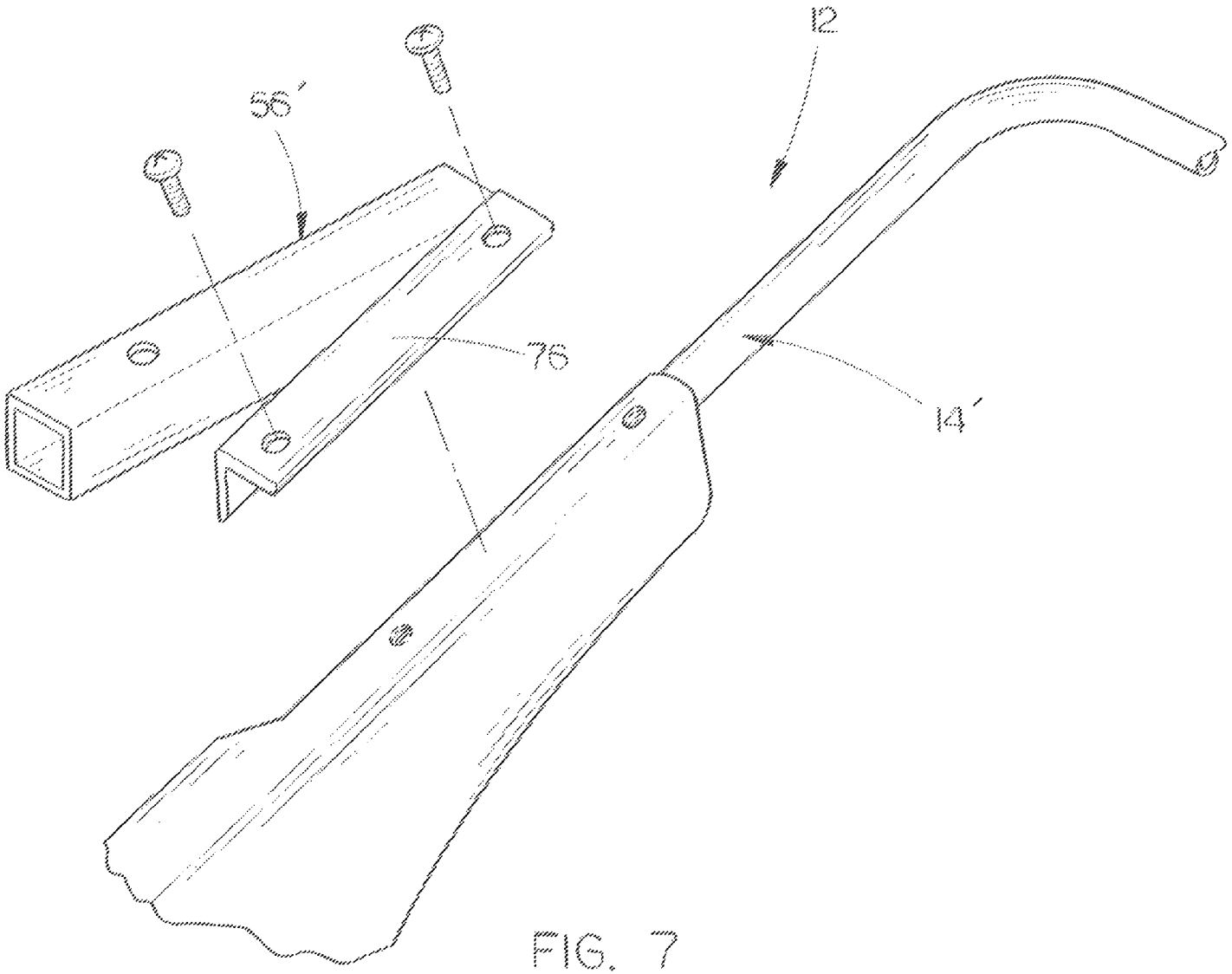
FIG. 7 is a partial perspective view illustrating how the grill of this invention is secured to the second infrared heater.

In FIGS. 1, 3, 4 and 5, the numeral 10 refers to Model No. VAL6 KBE5S while the numeral 12 refers to Model No. VAL6 EPX in FIGS. 6 and 7.

Heater 10 includes a wheeled frame 14 for moving the heater from one place to another. Frame 14 includes a first end 16, second end 18, first side 20 and second side 22. Frame 14 has a transversely extending axle 24 at the second end 18 which has wheels 26 and 28 mounted on the ends thereof. A skid assembly 30 is provided on frame 14 at the first end 16. The heater components of the heater 10 are mounted on the frame 14 so that the radiation disk 32 emits infrared rays from the second side 22 of the frame 14.

The numeral 34 refers to a protective grill which may be used in conjunction with heater 10 to reduce the possibility of a person coming into contact with the radiation disk 32 which will be extremely hot when the heater is activated. Grill 34 includes a first generally horizontally disposed leg portion 36 having a first end 38 and a second end 40. As seen, leg portion 36 includes a portion 42 which extends laterally outwardly from first end 38. Grill 34 also includes a second generally horizontally disposed leg portion 44 having a first end 46 and a second end 48. As seen, leg portion 44 includes a portion 50 which extends laterally outwardly from first end 46. Grill 34 also includes a third leg portion 52 which extends between the end 40 of leg portion 36 and the end 48 of leg portion 44. Preferably, grill 34 also includes a fourth leg portion or grill portion 54 which is positioned below leg portion 52 as seen in FIG. 2.

The numeral 56 refers to an elongated and generally horizontally disposed hollow tube member having a first end 58 and a second end 60. Tube member 56 is secured to frame 14 at end 16 by any convenient means such as screws, bolts, etc. The numeral 62 refers to an elongated and generally horizontally disposed hollow tube member having a first end 64 and a second end 66. Tube member 62 is secured to frame 14 at end 18 by any convenient means such as screws, bolts, etc.

Tube member 56 has an upstanding post 68 secured thereto which extends upwardly therefrom between the ends 58 and 60 of tube member 56. Tube member 62 has an upstanding post 70 secured thereto which extends upwardly therefrom between the ends 64 and 66 thereof.

Figure 1:
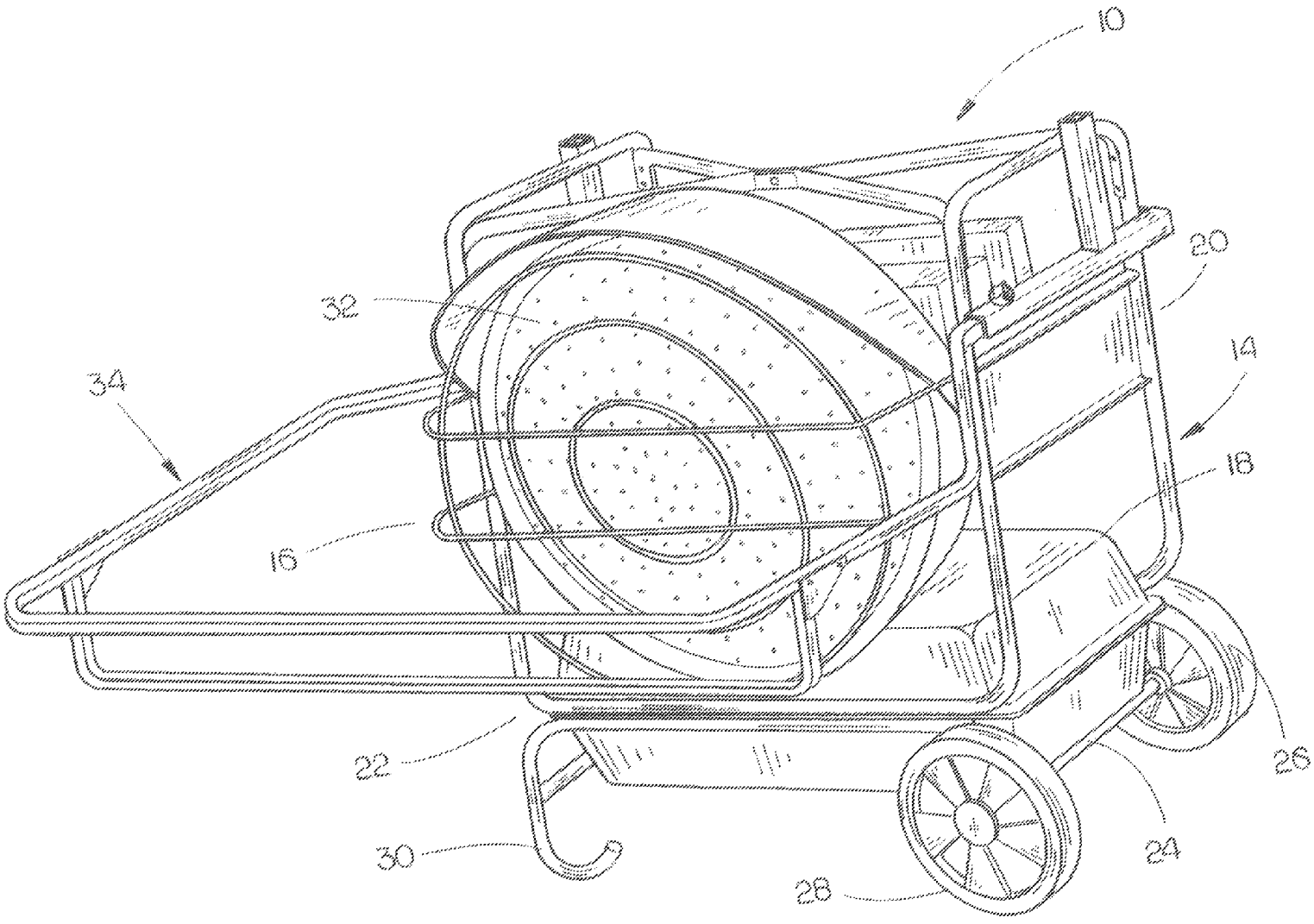
FIG. 1 is a perspective view of the wheeled member of this invention which is selectively removably secured to an infrared heater where the radiation disk thereof is positioned at one side thereof.
Figure 2:
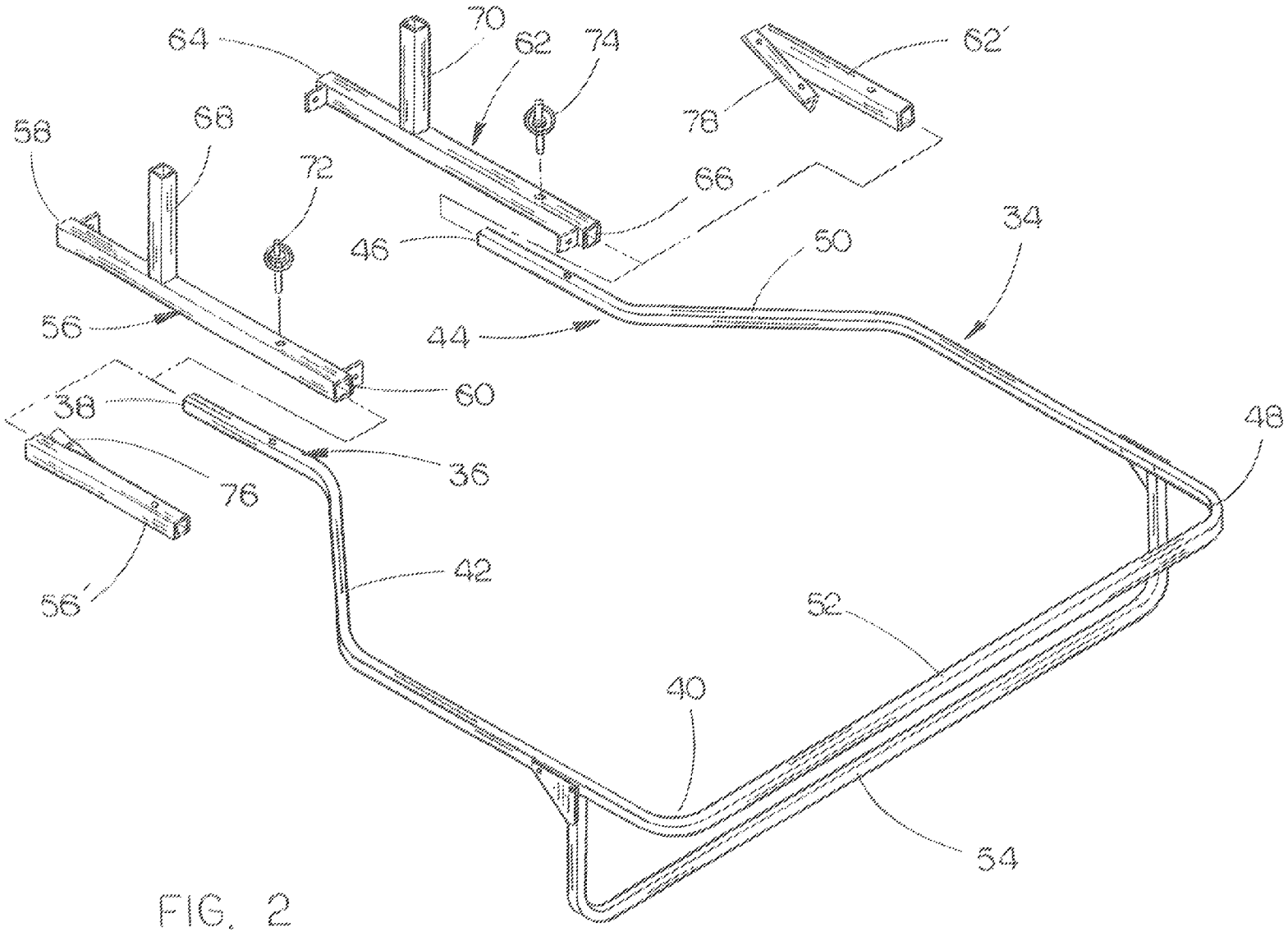
FIG. 2 is an exploded perspective view of the grill of this invention which discloses the means for securing the grill member to the wheeled frame of the infrared heater to enable the grill to be positioned at one side of the heater or at one end of the heater.
Figure 3:
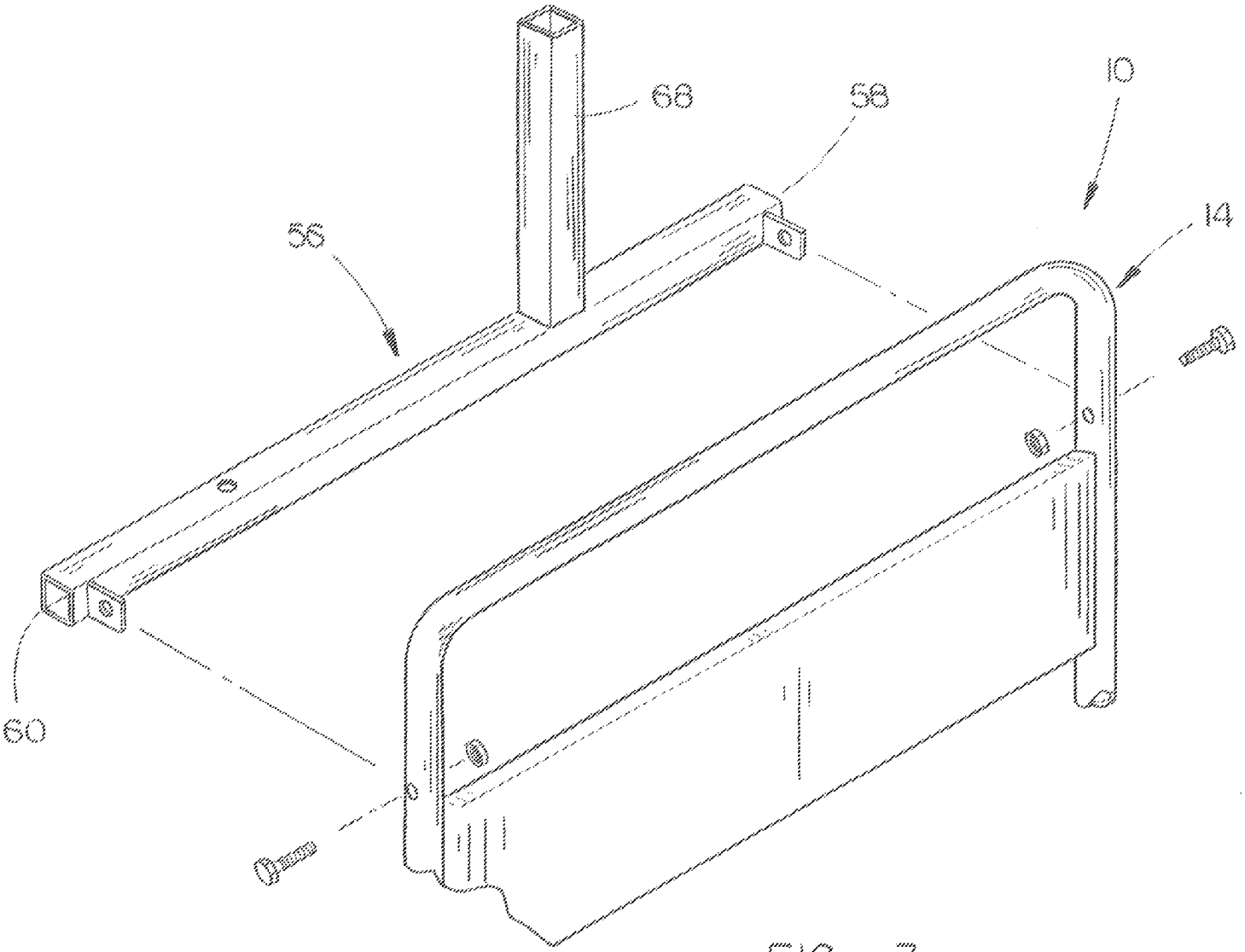
FIG. 3 illustrates the manner in which the first embodiment may be attached to the heater.

When it is desired to put heater 10 into operation, the ends 38 and 46 of leg portions 36 and 44 are inserted into the ends 60 and 66 of tube members 56 and 62 respectively and secured thereto by pins 72 and 74 respectively which extends through registering openings formed in tube members 56 and 62 and leg portions 36 and 44 as seen in FIG. 2.

When grill 34 is positioned in place, the leg portions 52 and 54 are preferably spaced 12 to 24 inches outwardly of the radiation disk 32. The grill 34 provides a "halo" around the radiation disk to reduce the possibility of a person coming into contact with the radiation disk 32.

When it is necessary to move the heater 10 from one location to another through a doorway or the like, the grill 34 is detached from the tube members 56 and 62 with the leg portions 36 and 44 being inserted downwardly into the posts 68 and 70 respectively so that the grill 34 is vertically disposed as illustrated in FIG. 4 and is illustrated by broken lines in FIG. 5.

FIG. 6 illustrates the heater 12 having the grill 34 secured thereto. Since the radiation disk 32 is positioned at one end of the wheeled frame 14, there is no need to position the grill 34 in a vertically disposed manner for transport. The only difference between the mounting of grill 34 on heater 12 is that the tube members 56' and 62' into which the leg portions 36 and 44 are inserted are supported by brackets 76 and 78 which are secured to the wheeled frame 14'.

Thus it can be seen that a novel grill has been provided for a portable infrared heater which reduces the possibility of a person coming into contact with the radiation disk of the heater whether the radiation disk is mounted at one end of the heater or is mounted at one side of the heater.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. In combination a portable infrared heater and a protective grill for use with said infrared heater;

Said portable infrared heater comprising a wheeled frame having a first end, a second end, a first side and a second side and a radiation disk having upper and lower ends, at said second side thereof which directs infrared rays outwardly from said second side thereof;

said protective grill for use with said infrared heater comprising:

a. a first elongated, generally horizontally disposed hollow tube member, having first and second ends, connected to said wheeled frame at said first end thereof;

b. said first tube member being positioned in a plane between said upper and lower ends of said radiation disk;

c. a second elongated, generally horizontally disposed hollow tube member, having first and second ends, connected to said wheeled frame at said second end thereof;

d. said second tube member being positioned in a plane between said upper and lower ends of said radiation disk;

e. a generally horizontally disposed first leg portion having first and second ends;

f. a generally horizontally disposed second leg portion having first and second ends;

g. an elongated and generally horizontally disposed third leg portion having first and second ends;

h. said first leg portion including an inner leg member, having first and second ends;

i. said first end of said inner leg member of said first leg portion being selectively removably received in said second end of said first tube member;

j. said first leg portion also including an intermediate leg member, having first and second ends, which extends laterally and outwardly from said second end of first leg member of said first leg portion;

k. said first leg portion also including an outer leg member, having first and second ends, which extends outwardly from said second end of said intermediate leg member of said first leg portion so as to be parallel to said inner leg member thereof;

l. said second leg portion including an inner leg member, having first and second ends;

m. said first end of said inner leg member of said second leg portion being selectively removably received in said second end of said second tube member;

n. said second leg portion also including an intermediate leg member, having first and second ends, which extends laterally and outwardly from said second end of said first leg member of said second leg portion;

o. said second leg portion also including an outer leg member, having first and second ends, which extends outwardly from said second end of said intermediate leg member of said second leg portion so as to be parallel to said inner leg member thereof;

p. said first end of said third leg portion being connected to said second end of said outer leg member of said first leg portion;

q. said second end of said third leg portion being connected to said second end of said outer leg member of said second leg portion;

r. said third leg portion being positioned at least twelve inches from said radiation disk when said first end of said first leg member of said first leg portion is received by said second end of said first tube member and said first end of said first leg member of said second leg portion is received by said second end of said second tube member.

2. The combination of claim 1 wherein said third leg portion of said protective grill member is positioned at least twelve to twenty-four inches from said radiation disk.

3. The combination of claim 1 wherein said third leg portion has a length which is greater than the distance between said first and second tube members.

4. The combination of claim 1 wherein said protective grill includes an elongated and horizontally extending fourth leg portion which is positioned below said third leg portion and which is parallel to said third leg portion.

5. The combination of claim 1 wherein said wheeled frame includes an elongated axle at the second end thereof which extends between the first and second sides of said wheeled frame with said axle having a rotatable wheel at each of the ends thereof.

6. In combination a portable infrared heater and a protective grill for use with said infrared heater;

Said portable infrared heater comprising a wheeled frame having a first end, a second end, a first side and a second side and a radiation disk having upper and lower ends, at said second end thereof which directs infrared rays outwardly from said second end thereof;

said protective grill for use with said infrared heater comprising;

a. a first elongated, generally horizontally disposed hollow tube member, having first and second ends, which is connected to said wheeled frame at said first side thereof;

b. said first tube member being positioned in a plane, between said upper and lower ends of said radiation disk;

c. a second elongated, generally horizontally disposed hollow tube member, having first and second ends, which is connected to said wheeled frame at said second side thereof;

d. said second tube member being positioned in a plane between said upper and lower ends of said radiation disk;

e. a generally horizontally disposed first leg portion having first and second ends;

f. a generally horizontally disposed second leg portion having first and second ends;

g. an elongated and generally horizontally disposed third leg portion having first and second ends;

h. said first leg portion including a first leg member, having first and second ends;

i. said first end of said first leg member of said first leg portion being selectively removably received in said second end of said first tube member;

j. said first leg portion also including an intermediate leg member, having first and second ends, which extends laterally and outwardly from said second end of first leg member of said first leg portion;

k. said first leg portion also including an outer leg member, having first and second ends, which extends outwardly from said second end of said intermediate leg member of said first leg portion so as to be parallel to said inner leg member thereof;

l. said second leg portion including a first leg member, having first and second ends;

m. said first end of said first leg member of said second leg portion being selectively removably received in said second end of said second tube member;

n. said second leg portion also including an intermediate leg member, having first and second ends, which extends laterally and outwardly from said second end of said first leg member of said second leg portion;

o. said second leg portion also including an outer leg member, having first and second ends, which extends outwardly from said second end of said intermediate leg member of said second leg portion so as to be parallel to said inner leg member thereof;

p. said first end of said third leg portion being connected to said second end of said outer leg member of said first leg portion;

q. said second end of said third leg portion being connected to said second end of said outer leg member of said second leg portion;

r. said third leg portion being positioned at least twelve inches from said radiation disk when said first end of said first leg member of said first leg portion is received by said second end of said first tube member and said first end of said first leg member of said second leg portion is received by said second end of said second tube member.

7. The combination of claim 6 wherein said third leg portion of said protective grill member is positioned at least twelve to twenty-four inches from said radiation disk.

8. The combination of claim 6 wherein said third leg portion has a length which is greater than the distance between said first and second tube members.

9. The combination of claim 6 wherein said protective grill includes an elongated and horizontally extending fourth leg portion which is positioned below said third leg portion and which is parallel to said third leg portion.

10. The combination of claim 6 wherein said wheeled frame includes an elongated axle at the second end thereof which extends between the first and second sides of said wheeled frame with said axle having a rotatable wheel at each of the ends thereof.

* * * * *